US005660309A

United States Patent [19]

Belanger et al.

[11] Patent Number: 5,660,309

[45] Date of Patent: Aug. 26, 1997

[54] UMBRELLA TOTE STRAP

[76] Inventors: Carol A. Belanger, 235 Montgomery St., Ste. 705, San Francisco, Calif. 94104; Julia J. Smith, 2637 Monta Vista, El Cerrito, Calif. 94530

[21] Appl. No.: 666,943

[22] Filed: Jun. 17, 1996

Related U.S. Application Data

[63] Continuation-in-part of Ser. No. 526,643, Sep. 11, 1995.

[51] Int. Cl.[6] ..... A45F 3/14

[52] U.S. Cl. ..... 224/250; 224/257; 224/915

[58] Field of Search ..... 224/915, 257, 224/258, 150, 917, 250, 910

[56] References Cited

U.S. PATENT DOCUMENTS

| | | | |
|---|---|---|---|
| D. 283,758 | 5/1986 | Stewart et al. | D3/30.1 |
| 3,580,262 | 5/1971 | Weber . | |
| 4,760,944 | 8/1988 | Hughes | 224/150 |
| 4,967,943 | 11/1990 | Massey . | |
| 5,080,118 | 1/1992 | Allen . | |
| 5,318,055 | 6/1994 | Olaniyan . | |
| 5,323,941 | 6/1994 | Sobolev . | |
| 5,353,977 | 10/1994 | Schiro, Jr. et al. . | |

FOREIGN PATENT DOCUMENTS

| | | | |
|---|---|---|---|
| 9300028 | 1/1993 | WIPO | 224/258 |

*Primary Examiner*—Linda J. Sholl

[57] ABSTRACT

A tote strap for an umbrella, for carrying the umbrella when not in use. The tote strap comprises a flexible strap having at one end a first loop, and at the other end a second loop. The first loop is placed over the handle of the umbrella. The second loop is twisted prior to being stitched in place, thereby causing the resultant configuration to be frustoconical. The end of the umbrella penetrates the second loop until the generally frustoconical collapsed canopy of the umbrella abuts the second loop. A sling for carrying the folded umbrella over the shoulder by engaging two ends of the umbrella is thereby formed.

2 Claims, 2 Drawing Sheets

UMBRELLA TOTE STRAP

REFERENCE TO RELATED APPLICATION

This application is a Continuation-In-Part of Ser. No. 08/526,643, pending, filed Sep. 11, 1995.

BACKGROUND OF THE INVENTION

1. Field of the Invention

The present invention relates to a strap for toting an umbrella, the strap having an opening at one end, and a large loop at the other end. The strap engages the umbrella at the handle of the umbrella by the opening and also at the distal end of the umbrella by the loop when the umbrella is folded, thereby providing a removable sling. The strap is convertible to a tether engaging the user's arm when the umbrella is deployed.

2. Description of the Prior Art

Umbrellas are somewhat unwieldy to carry both while deployed, and when folded. The prior art has suggested numerous devices for supporting an umbrella in an erect condition while in use, so as to free the hands of the user.

Examples of such devices are seen in U.S. Pat. Nos. 3,580,262, issued to Heinz Weber on May 25, 1971, 4,967,943, issued to Brent F. Massey on Nov. 6, 1990, 5,080,118, issued to James H. Allen on Jan. 14, 1992, 5,318,055, issued to Olajide O. Olaniyan on Jun. 7, 1994, 5,323,941, issued to Evgeny I. Sobolev on Jun. 28, 1994, and 5,353,977, issued to Frank P. Schiro, Jr., et al. on Oct. 11, 1994. However, each of these devices generally includes a rigid holster secured to the wearer, for supporting the handle of the umbrella, and most also include a harness for providing a second point of attachment to the wearer.

An examination of these patents reveals that the closest component to the sling of the present invention is found in Massey's carrier. The hook portion (identified by reference numeral 5 throughout the Drawings) comprises a member having a socket and clamp arrangement at one end, for engaging the central shaft of the umbrella, the other or distal end draped over the wearer's shoulder. The distal end lacks structure for surroundingly engaging an object, as occurs in the present invention. Also, no socket and clamping arrangement is found in the present invention.

Furthermore, this member is described as being fabricated from a flexible plastic material for conforming to different shoulder sizes. This is contradicted to a certain degree by its purpose. This member rests on and conforms to the configuration of the wearer's shoulder. Therefore, it must have sufficient rigidity to maintain its cooperation with the shoulder, or else it would immediately slip free of the shoulder. By contrast, flexibility of the material of the present invention may be infinite.

None of the above inventions and patents, taken either singly or in combination, is seen to describe the instant invention as claimed.

SUMMARY OF THE INVENTION

The present invention answers the need for carrying about an umbrella when not in use. While a conventional umbrella is folded or collapsed to minimize its volume when not in use, it nonetheless remains a bulky object too large to be carried in a pocket, which must be grasped by the user. In some cases, devoting one arm to carrying the umbrella may not be objectionable. But in many cases, for example, for shoppers and those commuting to and from work, it may be highly desirable to leave both arms unencumbered for other purposes.

Therefore, apparatus for conveniently carrying a folded umbrella upon the user's body or torso is quite desirable. The present invention is employed as a sling for securing a folded umbrella parallel against the user's body. In this manner, awkwardness of handling the bulk of the umbrella is minimized, and obtrusiveness of the folded umbrella is minimized.

To these ends, the novel carrier comprises an uncomplicated sling fabricated from a ribbon of stock material having predetermined thickness and width. This construction enables the novel sling to be fabricated inexpensively in only two steps.

In a first step, one end is folded over onto itself to define an opening just large enough to slip over the handle of the umbrella, and is stitched or otherwise fastened in this position. In a second step, the other end is folded over onto itself and stitched in this configuration, thus forming a loop for receiving the end of the umbrella. In the second step, the material is twisted or inverted so that the abutting surfaces of the stitched joint are not the same surface of the original material. By contrast, in the first step, the material is merely folded such that the abutting surfaces are from the same side of the material.

The loop is slipped over the distal end of the umbrella. The umbrella is then supported at its two ends by a flexible sling, which is readily carried on the shoulder of the user. Both arms of the user are unencumbered when the umbrella is carried in this manner.

Many commonly available materials are suitable for fabricating the sling. A woven synthetic fiber, such as nylon may be employed. Alternatively, a natural material such as leather may be preferred.

The sling is fully removable from the umbrella, which has the further advantage that a sling may be acquired for use with any umbrella. The umbrella and sling need not be a carefully designed, matched pair.

In a preferred embodiment, the loop engaging the end of the umbrella is frustoconical, so that the loop opposes excessive penetration of the umbrella into the loop. Frustoconical configuration is achieved by twisting the material prior to folding and stitching. Abutment arresting penetration of the umbrella through the loop is thus assured regardless of precise dimensions of the umbrella. This arrangement assures that the umbrella is engaged at two points, each point spaced well apart from the other. The umbrella is thereby effectively grasped and controlled by the sling.

Accordingly, it is a principal object of the invention to provide a sling for carrying a folded umbrella on the body of a user.

It is another object of the invention to leave both arms and hands unencumbered when the umbrella is secured to the body.

An additional object of the invention is to provide a frustoconically configured pocket for receiving an umbrella, whereby penetration is arrested by abutment regardless of precise umbrella dimensions.

It is a further object of the invention to orient the carried umbrella parallel to the body, thereby minimizing obtrusiveness of the umbrella.

Still another object of the invention is to fabricate the sling from a ribbon of stock material.

An additional object of the invention is that the sling be removable from the umbrella.

It is again an object of the invention to grasp the umbrella effectively at two spaced apart points therealong.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
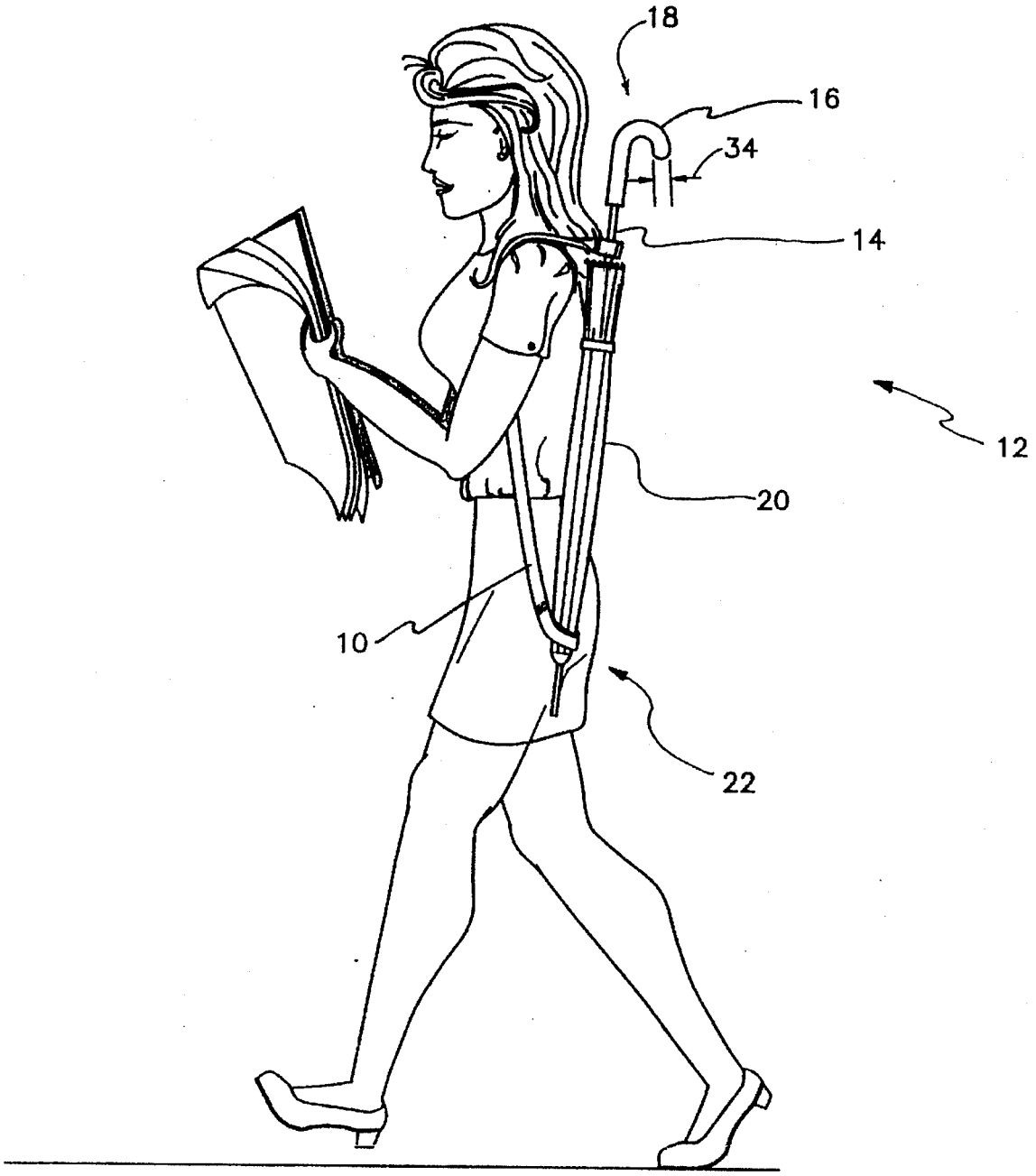
FIG. 1 is a perspective, environmental view of an umbrella carried by the novel sling.

Turning now to FIG. 1 of the drawings, the novel sling or tote strap 10 is seen deployed, engaging an umbrella 12 and resting on the shoulder of a user. Umbrella 12 is of conventional construction, having a central shaft 14 supporting a handle 16 at its proximal end 18, and a foldable or collapsible canopy 20 fastened proximate a distal end 22 of umbrella 12. The distal end 22 of umbrella 12 is shown to be pointed, but may alternatively be blunt.

Figure 2:
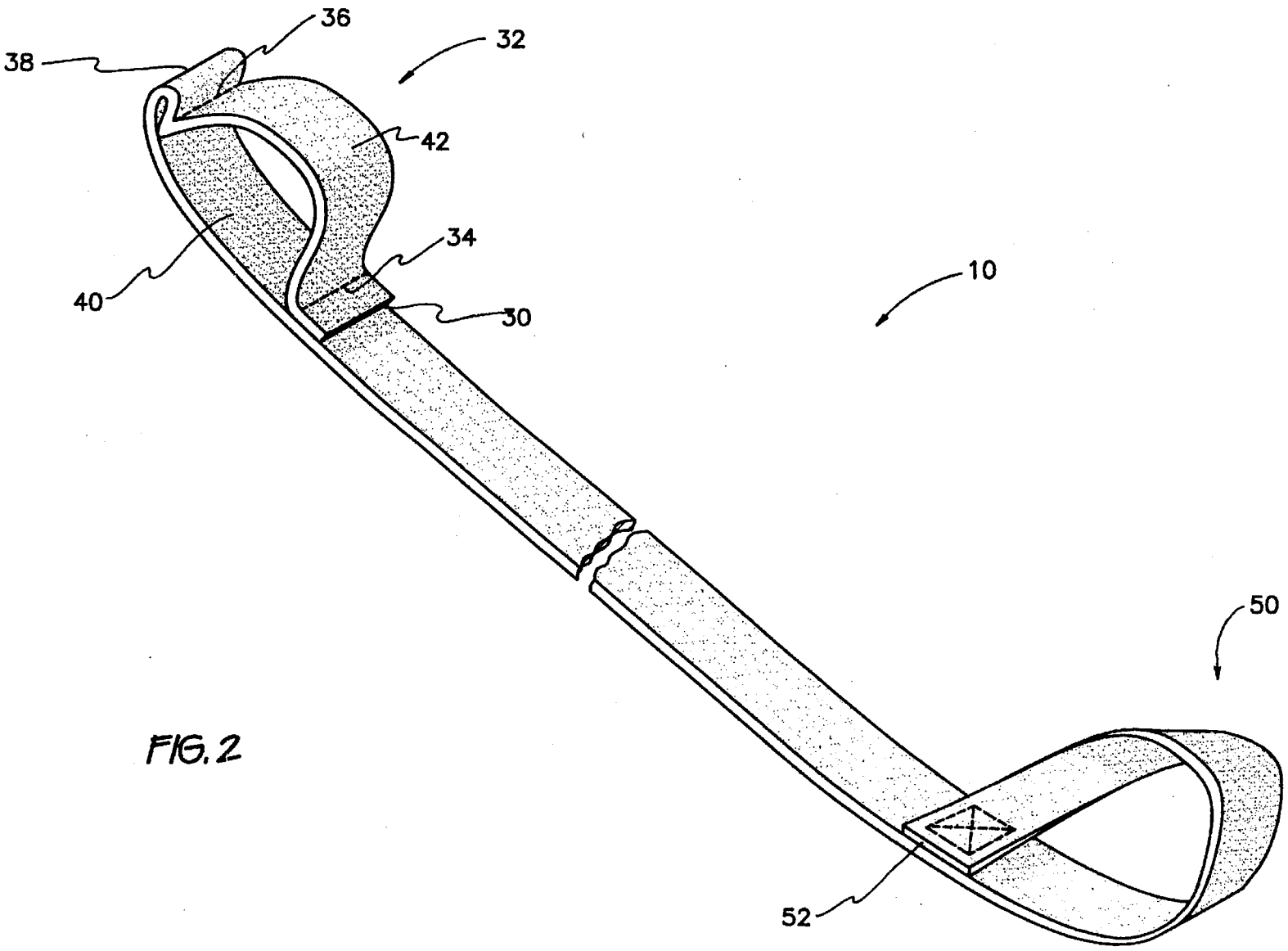
FIG. 2 is an enlarged perspective view of the novel sling.

Sling 10 is better seen with reference to FIG. 2. Sling 10 is seen to comprise a strap which is fabricated from a flexible material which is inelastic or of limited elasticity. A slight degree of elasticity would be acceptable if not allowing sling 10 to stretch when in use such that either end 18 or 22 of umbrella 12 could spontaneously escape engagement. The strap has a predetermined thickness dimension and width dimension. The length dimension of sling 10 is determined by the overall length dimension of the associated umbrella 12.

The strap forming sling 10 has a proximal end 30 at which is formed a first loop 32 for encircling handle 16 of umbrella 12. Loop 32 is formed by folding the strap over onto itself into a folded position and fastening the strap in this folded position by a first row of stitching 34.

It is possible that the strap will be formed from a material which is somewhat thick or stiff, and thus resistant to folding. If this is the case, then it is desirable to provide a second row of stitching 36 in close proximity to fold 38 formed in loop 32. Loop 32 may be regarded as comprising a base section 40 of the strap and a complementary section 42 which overlies base section 40 after fold 38 is made.

First row of stitching 34 secures distal end 30 of the strap to base section 40 of the strap, thereby establishing an opening 44 for receiving handle 16 of umbrella 12. Second row of stitching 36 is disposed proximate fold 38, with opening 44 being located between first and second rows of stitching 34, 36. The purpose of second row of stitching 36 is to minimize radius of curvature of the strap at a transition between base section 40 and complementary section 42 of the strap. Although fold 38 need not be flat, wherein meeting surfaces of base section 40 and complementary section 42 abut, fold 38 will nonetheless be a sharp fold, and loop 32 will remain somewhat flat. Flatness of loop 32 both opposes opening which might otherwise allow handle 16 of umbrella 12 to slip off inadvertently, and also maintains a more compact configuration.

A second loop 50 for encircling distal end 22 of umbrella 12 is formed at a distal end 52 of the strap by folding the strap over onto itself again into a folded position as follows. Distal end 52 of the strap is fastened at a severe angle, preferably a right angle, to the strap. Second loop 50 is thus rendered frustoconical while being formed from only a single length of strap and from stitching. As seen in FIG. 2, contacting sections of the strap forming loop 50 are arranged at a right angle to one another and stitched or otherwise attached to one another in this orientation. Loop 50 is therefore frustoconical along most of its circumference. This is as contnisted to loop 32, in which contacting sections of the strap forming loop 32 are parallel to one another at their point of attachment.

The frustoconical configuration of loop 50 is preferred for better engaging the end of the umbrella, but may be modified if desired. The frustoconical configuration cooperates with the general conical configuration of a folded umbrella by providing surfaces assuring eventual interference with the umbrella when the umbrella is inserted into loop 50. The umbrella is thus prevented from penetrating excessively through loop 50, and the umbrella thus is effectively grasped.

The preferred methods of construction enable sling 10 to be formed from a ribbon of stock material of predetermined thickness dimension 38 and width dimension 40. As employed herein, the term "ribbon" signifies an indeterminate length from which is cut a suitable section of desired length, as determined by dimensions of umbrella 12, prior to formation of opening, and stitching of loop 28. Thus, a great many slings 10 may be fabricated from a single bulk length of stock material.

If desired, securement of the strap in forming loops 32 and 50 may be by methods other than stitching, such as rivetting, snapping, hook and loop attachment, adhesives (none of these shown), or in still other ways. The precise stitching patterns illustrated are not critical to the invention, as long as effective fastening results.

It is to be understood that the present invention is not limited to the embodiments described above, but encompasses any and all embodiments within the scope of the following claims.

We claim:

1. A tote strap for an umbrella having a handle mounted on the proximal end of a central shaft, the central shaft also having a distal end, said tote strap comprising a strap fabricated from a flexible material, said strap having a proximal end and a distal end, said strap having a first loop for encircling the handle of the umbrella, said first loop formed at said proximal end by folding said strap over onto itself into a folded position and fastening said strap in said folded position, and a second loop for encircling the distal end of the umbrella, said second loop formed at said distal end of said strap by folding said strap over onto itself into a second folded position and fastening said strap in said second folded position, said first loop comprising a fold defined in said strap, a base section of said strap and a complementary section of said strap, a first row of stitching securing said distal end of said strap to said base section of said strap, thereby establishing an opening formed in said first loop, and a second row of stitching disposed proximate said fold, said opening being located between said first row of stitching and said second row of stitching, whereby said fold is a sharp fold.

2. A tote strap for an umbrella having a handle mounted on the proximal end of a central shaft, the central shaft also having distal end, said tote strap comprising a strap fabricated from a flexible material, said strap having a proximal end and a distal end, said strap having a first loop for encircling the handle of the umbrella, said first loop comprising a fold defined in said strap, a base section of said strap and a complementary section of said strap, a first row of stitching securing said proximal end of said strap to said base section of said strap, thereby establishing an opening formed in said second loop, and a second row of stitching disposed proximate said fold, said opening being located between said first row of stitching and said second row of stitching, whereby said fold is a sharp fold, and a second loop for encircling the distal end of the umbrella, said second loop formed at said distal end of said strap by folding said strap over onto itself into a second folded position, fastening said distal end of said strap at a right angle to said strap prior to fastening, and fastening said strap in said second folded position, whereby said second loop is rendered frustonconical while being formed from only a single length of strap and from fasteners.

* * * * *